United States Patent [19]

Inoue

[11] 4,343,111

[45] Aug. 10, 1982

[54] ULTRASONIC MACHINING METHOD AND APPARATUS

[75] Inventor: Kiyoshi Inoue, Tokyo, Japan

[73] Assignee: Inoue-Japax Research Incorporated, Yokohama, Japan

[21] Appl. No.: 114,557

[22] Filed: Jan. 23, 1980

[30] Foreign Application Priority Data

Jan. 24, 1979 [JP] Japan ..... 54/6107

[51] Int. Cl.[3] ..... B24B 1/04

[52] U.S. Cl. ..... 51/59 SS; 51/281 R

[58] Field of Search ..... 51/59 SS, 59 R, 281 R; 408/17; 156/73.1, 73.3, 580.1, 580.2; 228/1 R, 1 A

[56] References Cited

U.S. PATENT DOCUMENTS 2,791,066 5/1957 Mahlmeister ..... 51/59 SS 3,699,719 10/1972 Rozdilsky ..... 51/59 SS

*Primary Examiner*—Harold D. Whitehead

*Attorney, Agent, or Firm*—Karl F. Ross

[57] ABSTRACT

An improved ultrasonic machining method and apparatus wherein the vibratory oscillations applied to an ultrasonic machining tool and transmitted to the machining region are periodically interrupted so that they are applied and transmitted in the form of a series of time-spaced bursts.

6 Claims, 7 Drawing Figures

ULTRASONIC MACHINING METHOD AND APPARATUS

FIELD OF THE INVENTION

The present invention relates to ultrasonic machining and, more particularly, to an improved method of and apparatus for machining, e.g. cutting and grinding, a workpiece by means of an ultrasonically vibrating tool which is disposed in a machining relationship with the workpiece across a cutting front in the presence or absence of abrasive particles distributed therein or continuously supplied thereto.

BACKGROUND OF THE INVENTION

In the art of ultrasonic machining as described above, the vibratory energy applied to the tool is transmitted to the cutting front, i.e. the tool-to-workpiece interface, in which the abrasive medium such as diamond, tungsten-carbide, boron-carbide or boron-nitride particles may be present to enhance the cutting action, to effectively work on various materials such as ceramics, calcined or vitreous materials, graphite and so on. According to the prior-art practice, the vibratory energy or oscillations applied the tool and hence transmitted to the cutting front are commonly uniform in nature and also commonly require a preset frequency and amplitude for a given machining operation. Nevertheless, where the workable surface contains a curvature, it has been recognized that there results a considerable surface (finish) irregularity in the ultrasonically machined surface.

OBJECTS OF THE INVENTION

It is, accordingly, a principal object of the present invention to provide an improved ultrasonic machining method which allows a curved surface to be ultrasonically machined with a fine surface finish or smoothness, practically free from the irregularity which characterizes the prior art.

Another object of the present invention is to provide an improved ultrasonic machining apparatus which assures an improved cutting finish or is capable of executing the improved method with efficiency.

SUMMARY OF THE INVENTION

In accordance with the present invention there is provided an ultrasonic machining method wherein an ultrasonically vibrating tool is disposed in a machining relationship with a workpiece and juxtaposed with the workpiece across a cutting front to mechanically machine the workpiece by means of vibrating energy transmitted from the tool to the cutting front, wherein the improvement which comprises the step of modifying the vibratory energy by periodically interrupting the vibratory oscillations applied to the tool, thereby applying a series of time-spaced bursts of vibratory oscillations to the cutting front. The improvement preferably further includes the step of modifying the frequency and/or amplitude of the vibratory oscillations during each of the time-spaced bursts.

In accordance with the apparatus aspect of the present invention, means for modifying the vibratory energy includes means for periodically interrupting the vibratory oscillations applied to the tool, with or without means for modifying the frequency and/or amplitude of the vibratory oscillations applied to the tool.

SPECIFIC DESCRIPTION

Figure 1:
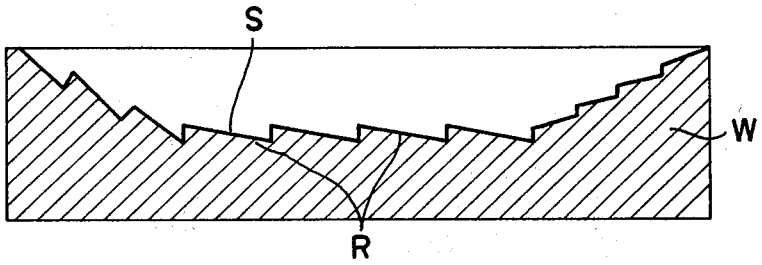
FIG. 1 is a sectional view diagrammatically illustrating a curved machined section formed by the conventional ultrasonic machining method with its irregular surface.
Figure 2:
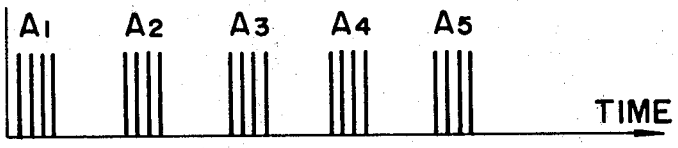
FIG. 2 is a waveform diagram illustrating a series of time-spaced bursts of vibratory oscillations in accordance with the invention.

Referring to FIG. 1, the conventional ultrasonic machining process, especially when it forms a curvature S on the workpiece W, is characterized by the formation of surface irregularities R along the curvature C. The surface irregularity generally takes the form of a terraced formation as diagrammatically depicted in FIG. 1. It has now been found that the formation of such surface irregularities is effectively obviated when the vibratory oscillations applied to the tool for transmittal to the working front thereof are periodically interrupted so that, as shown in FIG. 2, a series of time-spaced bursts A1, A2, A3, . . . of the vibratory oscillations results and are applied to the cutting front in the region of a workpiece.

Figure 3:
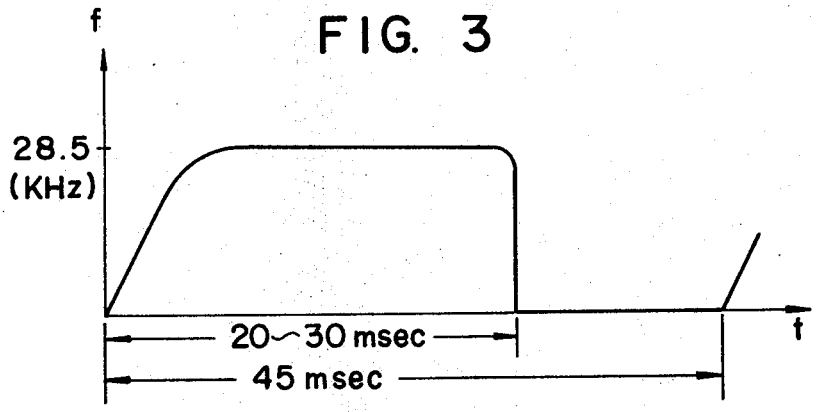
FIG. 3 is a waveform diagram illustrating a typical example of the vibrational modification in each burst.

In accordance with an additional feature of the invention, during each of the successive bursts A1, A2, A3, . . . , the frequency and/or amplitude of the vibratory oscillations are preferably varied. FIG. 3 shows a typical example of the vibrational modification. The waveform shown has the frequency (f) plotted along the ordinate and the time (t) plotted along the abscissa. In each burst A, it is shown that the frequency is gradually increased up to the full 23.5 KHz. The burst or on time is shown to have 20 to 35 msec. and to be followed by off time with the period being 45 msec.

Figure 4:
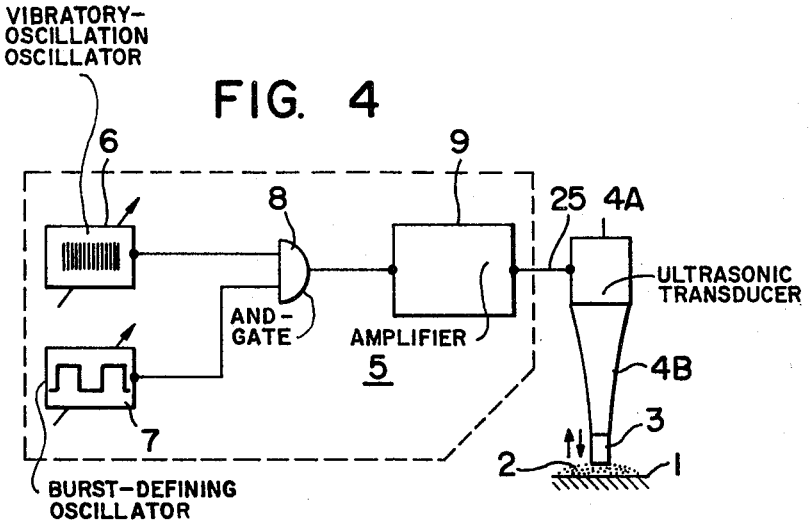
FIG. 4 is a schematic view partly in section diagrammatically illustrating an ultrasonic machining system embodying the present invention.

FIG. 4 shows an ultrasonic machining system designed to carry out the method aspect of the present invention. In this system, a workpiece to be machined is designated at 1, which may have abrasive particles, grains or grit such as diamond, WC, B4C or BN distributed thereon. Juxtaposed or disposed in a machining relationship with the workpiece 1 is a tool 3 carried by a horn 4B to which a transducer 4A is secured for converting electrical oscillations to mechanical oscillations and may be, for example, a piezoelectric element. The mechanical oscillations generated at the transducer 4A and amplified through the horn 4B are transmitted to the tool head 3 to cause it to vibrate at an intensity sufficient to bring about ultrasonic cutting actions against the workpiece 1.

The transducer 4A is energized by a power supply generally denoted at 5. The power supply 5 comprises a first oscillator 6 and a second oscillator 7 which are tied together at an AND gate 8 whose output is applied to the transducer 4A via an amplifier 9. The first oscillator 6 provides ultrasonic-frequency signals applied to the transducer 4A and converted by it into the corresponding ultrasonic mechanical or vibratory oscillations which are applied to the tool 3. The frequency and amplitude of the vibratory oscillations are therefore set at the first oscillator 6.

The function of the second oscillator 7 is to provide a periodic interruption signal for the first oscillator signal passing through the gate 8 so that a series of time-spaced bursts of the ultrasonic frequency electrical oscillations are outputted by the AND gate 8 to energize the transducer 4A. The result is the development at the tool 3 of a series of time-spaced bursts of mechanical or vibratory oscillations of a desired frequency and amplitude characteristics. The duration or on-time and the interval or off-time between the successive bursts are set at the second oscillator 7.

Figure 5A:
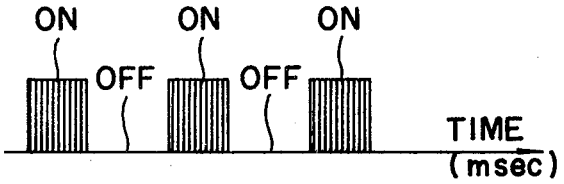
FIGS. 5A, 5B and 5C are waveform diagrams illustrating different forms of bursts of vibratory oscillations which may be embodied according to the invention.
Figure 5B:
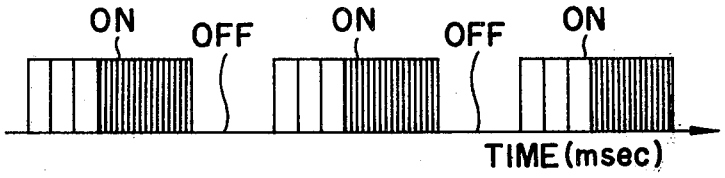
Figure 5C:
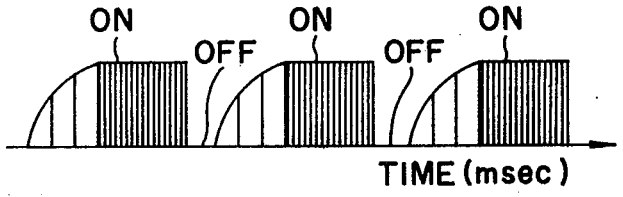

FIGS. 5(*a*), 5(*b*) and 5(*c*) show typical different forms of bursts of vibratory oscillations which may be used according to the invention. The waveform (a) represents a simple series of bursts with each burst containing a uniform frequency and amplitude characteristic throughout the duration. The waveform (b) uses each burst in which the frequency alone is varied, from a minimum value to the maximum. The waveform (c) uses each burst in which both the frequency and the amplitude of the vibratory oscillations are varied each from a minimum to a preset value during the initial period. The on-time and off-time of bursts, shown in FIG. 5(*a*) to be equal to each other, may be varied depending upon a particular application.

EXAMPLE

A workpiece composed of carbon steel (containing 0.85% by weight) is ground by ultrasonic machining using tungsten-carbide abrasive particles of grain sizes ranging between 5 and 150 microns. When vibratory oscillations of 28.5 KHz. and output 20 watts are applied continuously according to the conventional practice, the resulting surface has a roughness (raise to flat height difference) of 8 microns. When the same vibratory oscillations are applied in the form of a series of time-spaced bursts of an on-time of 25 msec and an off-time of 15 msec and each burst has a reduced frequency during the initial period of 2 msec followed by the frequency of 28.5 KHz during the balance of on-time—according to the waveform. (c) of FIG. 5 or the waveform of FIG. 3, the machined surface has a roughness of 1.4 micron. This shows that until a surface roughness of 0.1 $\mu$Rmax is reached, the conventional practice requires 18 minutes/cm$^2$ whereas the present invention only need 6 minutes/cm$^2$.

What is claimed is:

1. In an ultrasonic machining method wherein an ultrasonically vibrating tool is disposed in a machining relationship with a workpiece and juxtaposed with the workpiece across a cutting front to mechanically machine the workpiece by means of vibratory energy transmitted from the tool to the cutting front, the improvement which comprises the steps of:

(a) modifying said vibratory energy by intermittently interrupting the vibratory oscillations applied to said tool, thereby applying a series of time-spaced bursts of vibratory oscillations to said cutting front; and (b) modifying the frequency of said vibratory oscillations during each of said bursts.

2. The improvement defined in claim 1, further comprising the step of (c) modifying the amplitude of said vibratory oscillations during each of said bursts.

3. In an ultrasonic machining method wherein an ultrasonically vibrating tool is disposed in a machining relationship with a workpiece and juxtaposed with the workpiece across a cutting front to mechanically machine the workpiece by means of vibratory energy transmitted from the tool to the cutting front, the improvement which comprises the steps of:

(a) modifying said vibratory energy by intermittently interrupting the vibratory oscillations applied to said tool, thereby applying a series of time-spaced bursts of vibratory oscillations to said cutting front; and (b) modifying the amplitude of said vibratory oscillations during each of said bursts.

4. In an ultrasonic machining apparatus wherein an ultrasonically vibrating tool is disposed in a machining relationship with a workpiece and juxtaposed with the workpiece across a cutting front to mechanically machine the workpiece by means of vibratory energy transmitted from the tool to the cutting front, the improvement which comprises:

(a) means for modifying said vibratory energy by intermittently interrupting the vibratory oscillations applied to said tool, thereby applying a series of time-spaced bursts of vibratory oscillations to said cutting front; and (b) means for modifying the frequency of said vibratory oscillations during each of said bursts.

5. The improvement defined in claim 4, further comprising (c) means for modifying the amplitude of said vibratory oscillations during each of said bursts.

6. In an ultrasonic machining apparatus wherein an ultrasonically vibrating tool is disposed in a machining relationship with a workpiece and juxtaposed with the workpiece across a cutting front to mechanically machine the workpiece by means of vibratory energy transmitted from the tool to the cutting front, the improvement which comprises:

(a) means for modifying said vibratory energy by intermittently interrupting the vibratory oscillations applied to said tool, thereby applying a series of time-spaced bursts of vibratory oscillations to said cutting front; and (b) means for modifying the amplitude of said vibratory oscillations during each of said bursts.

* * * * *